United States Patent [19]

Furuhama

[11] Patent Number: 4,957,420

[45] Date of Patent: Sep. 18, 1990

[54] VANE PUMP WITH GUIDE MEANS FOR REGULATING MOVEMENT OF VANE

[75] Inventor: Shoichi Furuhama, Tokyo, Japan

[73] Assignee: Nippon Piston Ring Co., Ltd., Tokyo, Japan

[21] Appl. No.: 336,082

[22] Filed: Apr. 11, 1989

[30] Foreign Application Priority Data

Apr. 27, 1988 [JP] Japan ..... 63-102496

[51] Int. Cl.[5] ..... F04C 18/344

[52] U.S. Cl. ..... 418/255

[58] Field of Search ..... 418/253, 254, 255, 256, 418/259, 260

[56] References Cited

U.S. PATENT DOCUMENTS

| | | | |
|---|---|---|---|
| 883,224 | 3/1908 | Neville | 418/255 |
| 3,377,851 | 4/1968 | Komiya et al. | 418/255 |
| 3,381,668 | 5/1968 | Agren | 418/257 |
| 4,133,617 | 1/1979 | Reynaud | 418/255 |
| 4,385,873 | 5/1983 | Richter | 418/255 |

FOREIGN PATENT DOCUMENTS

| | | | |
|---|---|---|---|
| 5207 | 1/1979 | Japan . | |
| 102946 | 4/1989 | Japan . | |
| 1344947 | 10/1987 | U.S.S.R. | 418/255 |

*Primary Examiner*—John J. Vrablik
*Assistant Examiner*—David L. Cavanaugh

[57] ABSTRACT

A vane pump provided with a center housing, front and rear housings holding the center housing therebetween, a rotor eccentrically disposed in the center housing and rotatably supported by the front and rear housings, a single vane diametrically movably inserted in the rotor, and a guide for regulating the projection of the vane out of the rotor. The guide comprises an axle provided centrally on each side of the vane, a circular hole formed in the inner surface of each of the front and rear housings and having a center positioned just in the middle between both centers of the rotor and the center housing, and a rolling bearing interposed between the axle and the circular hole to guide the axle in a circular path having a diameter equal to the eccentricity of the rotor. The center housing has an inner surface with a cross-sectional profile that is firstly drawn by the tip of the vane when the rotor turns and then expanded by a preselected clearance.

6 Claims, 4 Drawing Sheets

VANE PUMP WITH GUIDE MEANS FOR REGULATING MOVEMENT OF VANE

BACKGROUND OF THE INVENTION

1. Field of the Invention

The present invention relates to an oil-free type vane pump which is utilizable as a supercharger for an internal combustion engine, and more particularly to a vane pump of the type having a device for regulating a vane movable in a rotor which is rotatably disposed at an eccentric position within a center housing.

2. Description of the Prior Art

The known oil-free type vane pump has a vane of which the tip slides along the inner surface of the center housing upon rotation of the rotor. The tip is forced to the inner surface of the center housing by a centrifugal force due to the rotation of the vane. This results to a disadvantage that a frictional loss rapidly increases between the tip of the vane and the inner surface of the center housing when the pump runs at high speeds.

In JP A 54-5207, a vane pump is shown with a plurality of vanes radially movable in a rotor and guide means for regulating the vane and receiving a centrifugal force exerted by the vane. The means comprises front and rear annular cam grooves formed in front and rear housings and front and rear guide pins, as cam followers, secured to both sides of each vane, whereby the annular cam grooves guide the motion of the vane and receive the centrifugal force through the intermediary of the pins. The annular cam groove has a cross-sectional profile similar to the inner surface of the center housing.

However, the vane pump as described above has disadvantages one of which is that the annular cam groove soon wears and can not be used for a long time. The reason for this is that the radial vane always has a large radius of gyration to bring a large centrifugal force when the rotor runs at high speeds and that the large centrifugal force presses the pin on the inner surface of the guide hole. Another disadvantage is that the vane pump has an efficiency lower than usual because of having a relatively large clearance between the tip of the vane and the inner surface of the center housing. When the inner surface of the center housing is circular in cross-section, the pin must follow in a non-circular path to guide the tip of the vane along the inner surface of the center housing or keep a constant clearance therebetween. Therefore, the clearance can not be kept constant where the annular cam groove and the inner surface of the center housing are cross-sectionally similar in profile to each other.

SUMMARY OF THE INVENTION

In view of the foregoing, it is an object of the invention to provide an improved vane pump of the type having guide means for regulating a vane, in which the means is usable for a long time without being worn out.

It is another object of the invention to provide an improved vane pump of the type having a guide means for regulating a vane, whereby the pump has a high pumping efficiency.

The present invention comprises a vane pump having a center housing, front and rear housings holding the center housing therebetween, inlet and outlet ports disposed in the upperside of the center housing, a rotor eccentrically mounted within the center housing and rotatably supported by the front and rear housings, a single vane diametrically movably inserted in the rotor, and guide means for regulating the projection of the vane out of the rotor. The means comprises an axle centrally formed on each side of the vane, a circular hole formed in the inner surface of each of the front and rear housings, and a rolling bearing interposed between the axle and the circular hole to move the center of the axle in a circular path having a diameter equal to the eccentric radius of the rotor with respect to the center housing.

The rotor is preferably composed of a pair of semicylindrical bodies, which are joined with each other by front and rear blocks to define a vane groove therebetween. The front and rear blocks are rotatably supported by the front and rear housings. Either of the front and rear blocks is shaped in the form of a driven pulley.

When the ball or roller bearing has its inner race closely fitted on the axle, the inner diameter of the circular hole is larger by the eccentricity of the rotor than the outer diameter of the bearing. When the bearing has its outer race closely fitted in the circular hole, the inner diameter of the bearing is larger by the eccentricity of the rotor than the outer diameter of the axle.

The inner surface of the center housing has a cross-sectional profile defined by a path which is firstly followed by the tip of the vane when the rotor turns and then modified by a preselected clearance. But, the inner surface of the center housing can be arcuate partly at the upper portion about the top point in which the rotor is closest to the inner surface of the center housing.

Upon rotation of the rotor, the axle rotates on the inner cylindrical surface of the circular hole through the intermediary of the bearing. The vane exerts a centrifugal force that pushes itself diametrically along the vane groove, while the hole regulates the projection of the vane from the vane groove to remain a preselected clearance between each tip of the vane and the inner surface of the center housing. The clearance between the tip of the vane and the inner surface of the center housing is so selected that it is too small to have an effect on the pumping efficiency.

Advantages offered by the invention are mainly that the vane pump is free from heat loss as well as abrasion due to a frictional contact between the inner surface of the center housing and the tip of the vane and that the vane pump can be used for a long time. Although the centrifugal force acting on the vane is received by the inner cylindrical surface of the circular hole through the axle, neither axle nor the hole wears. The reasons for this are that the axle and the hole make no sliding but rotating contact with each other and that the diametrical vane has a remarkably small radius of gyration as compared with the conventional radial vane. The inner surface of the center housing has such a profile that keeps the clearance between the tip of the vane and the inner surface of the center housing at a preselected small value and ensures a high pumping efficiency.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The invention will become more fully understood from the detailed description given hereinbelow and the accompanying drawings which are given by way of illustration only, and thus are not limitative of the present invention.

DETAILED DESCRIPTION OF THE INVENTION

Figure 1:
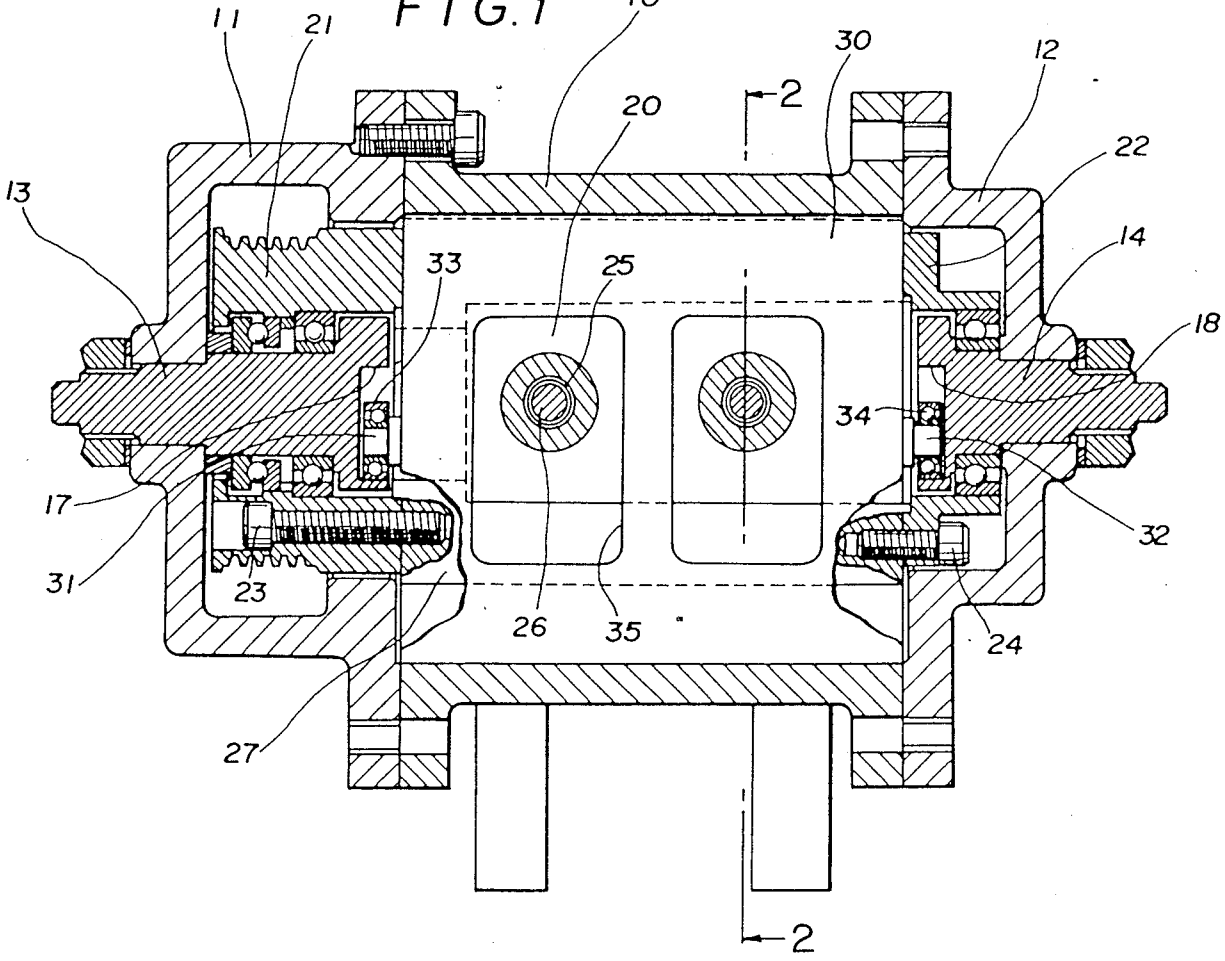
FIG. 1 is a longitudinal section of the vane pump according to the invention.

The present invention is described in detail below with reference to drawings which illustrate preferred embodiments. As seen in FIG. 1, a center housing 10 is put between front and rear side housings 11 and 12 and fastened together by bolts, one of which is shown. Front and rear shafts 13 and 14 are fixed to the front and rear side housings 11 and 12 by nuts. A front block or pulley 21 is secured to the front side of the rotor 20 by bolts 23. A rear block 22 is fixed to the rear side of the rotor 20 by bolts 24. The pulley 21 and the rear block 22 are rotatably fitted on the respective front and rear shafts 13 and 14.

Figure 2:
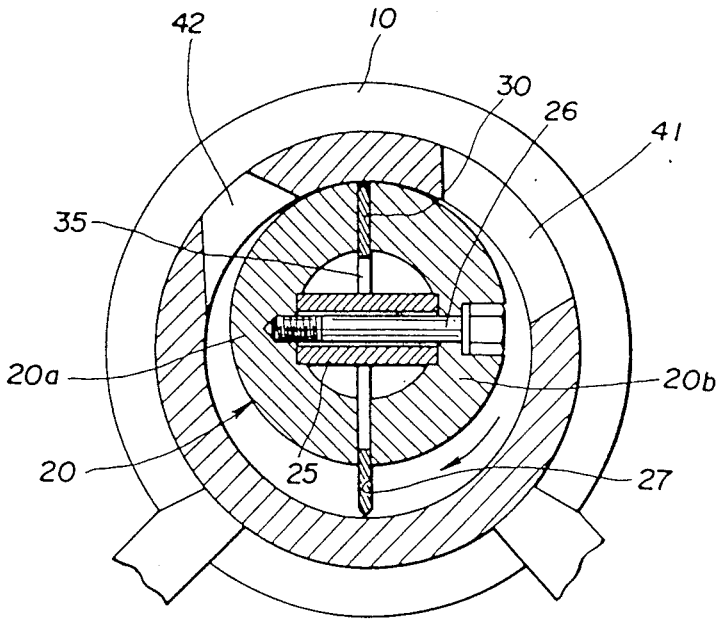
FIG. 2 is a section taken along the line II—II of FIG. 1.

As seen in FIG. 2, the rotor 20 is mounted at an eccentric position in the center housing 10. The rotor 20 is composed of two semicylindrical parts 20*a* and 20*b* holding a spacer 25 therebetween. The semicylindrical parts 20*a* and 20*b* are joined with each other by bolts 26 to form a vane groove 27 into which a single vane 30 is inserted.

As seen in FIGS. 1 and 2, the vane 30 diametrically passes through the rotor 20 and has long holes 35 into which spacers 25 and bolts 26 are inserted. The vane 30 is slightly shorter than an inner diameter of the inner surface of the center housing 10, so that there remains a small clearance between each tip of the vane and the inner surface of the housing 10.

Referring to FIG. 1, the ball bearings 33 and 34 have their inner race closely fitted on the front and rear axles 31 and 32, which are centrally formed on the front and rear sides of the vane 30. The bearings 33 and 34 are received within the front and rear circular holes 17 and 18 each having a center just in the middle between the both centers of the rotor 20 and the center housing 10. The difference between the inner diameter of the holes 17 and 18 and the outer diameter of the ball bearings 33 and 34 is equal to the eccentric radius of the rotor 20 with respect to the center housing 10 or half the maximum projection of the vane 30 from the rotor 20. The holes 17 and 18 regulate the projection of the vane 30 from the vane groove 27 through the intermediary of the bearings 33 and 34.

Referring to FIG. 2, the inner surface of the center housing 10 and the outer surface of the rotor 20 are closest to each other at their top point. Inlet and outlet ports 41 and 42 are disposed on the opposite sides of the top point. The inner surface of the center housing could have a circular cross-section with a radius larger than the eccentric radius of the rotor and a preselected clearance than the radius of the rotor if a pumping efficiency were out of question. But, in order to ensure a high pumping efficiency, it is necessary to determine the inner surface of the center housing 10 in conformity with a path of the tip of the vane 30.

Figure 3:
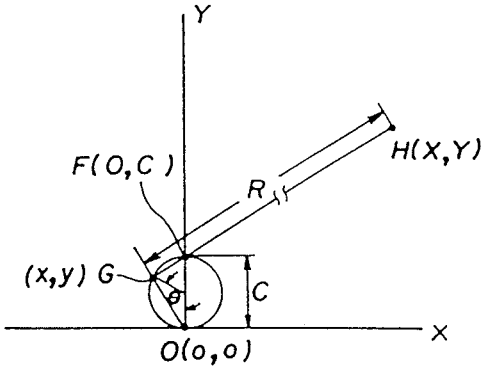
FIG. 3 is a schematic view laying out the inner surface of center housing.

A method of laying out the inner surface of the center housing is shown by FIG. 3, in which a circle with a diameter equal to the eccentricity C of the rotor has its lowermost point 0 (0, 0) positioned at the origin of X-Y coordinates or axis of the center housing. The circle corresponds to the path of the center of the vane. One tip of the vane is at a point H (X, Y) when the center of the vane is at a given point G (x, y) on the circle. The point H is on a line prolonged from the point G through the uppermost point F on the circle and at a distance equal to the radius R of the vane from the point G. The other tip is at a non-illustrated point which is symmetrical to the point H with respect to the point G and obtained by the same way as the point H. After many points have been plotted, the smooth curve drawn through those point is a path of the both tips of the vane. The path is expanded by a preselected clearance to obtain the profile of the inner surface of the center housing.

H (X, Y) is also calculatable by the following formulas:

$$X = R\cos\frac{\theta}{2} - \frac{C}{2}\sin\theta$$

$$Y = R\sin\frac{\theta}{2} - \frac{C}{2}\sin\theta + \frac{C}{2}$$

where $\theta$ is an angular displacement of the point G from the original point O (0, 0).

Figure 4:
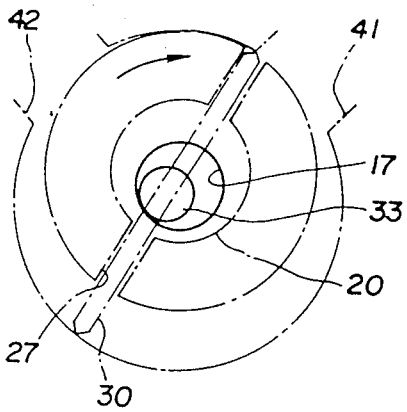
FIGS. 4 to 7 are views illustrating different stages of pumping action.
Figure 5:
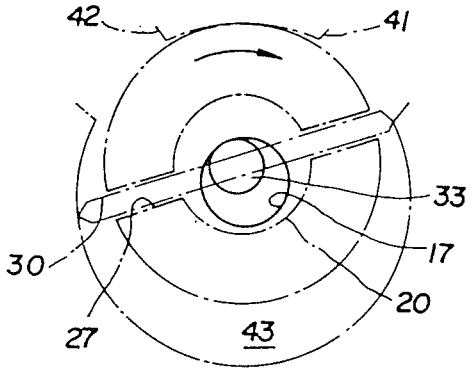
Figure 6:
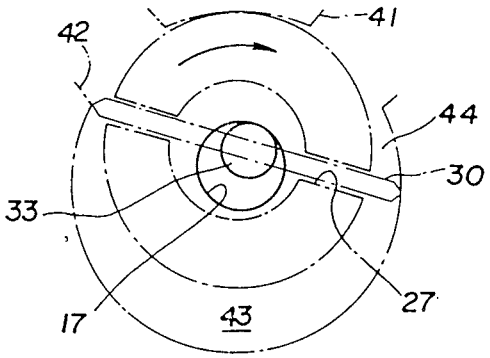
Figure 7:
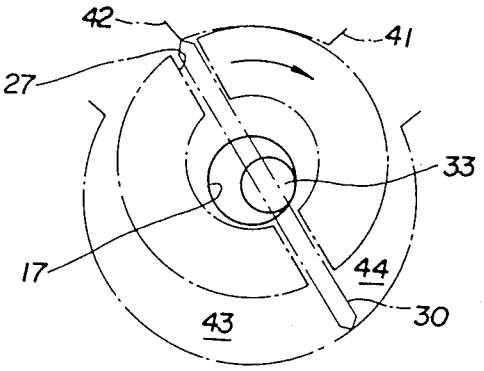

As seen in FIG. 4, the rotor 20 rotates toward the inlet port 41 through the top point from the outlet port 42. As seen in FIG. 5, fresh air is taken into the working room 43 from the inlet port 41 until the tip of the vane 30 runs past the port 41, while compressed air is discharged through the port 42 from the other working room. The outlet port 42 is preferably provided with a check valve, such as a reed valve or the like to prevent the compressed air from flowing backward. As seen in FIG. 6, when the opposite tip of the vane 30 comes to the port 42, the air is compressed in the working room while fresh air is taken into the working room 44. As seen in FIG. 7, the air is discharged from the working room 43 through the port 42 when the tip runs past the port 42. Thus, while the rotor 20 rotates, a pumping action is effective to take fresh air through the inlet port 41 and discharge the compressed air through the outlet port 42.

As seen in FIGS. 4 to 7, when the vane 30 rotates in the direction as shown by an arrow, the bearing 33 rolls on the inner surface of the circular hole 17. The rotating vane 30 exerts a centrifugal force to push the vane 30 along the vane groove 27 toward an underside thereof. However, the hole 17 regulates the projection of the vane 30 out of the vane groove 27 through the intermediary of the bearing 33 and maintain a preselected clearance between the tip of the vane 30 and the inner surface of the center housing. The clearance is too small to decrease the pumping efficiency. On the other hand, the opposite tip of the vane 30 is also prevented from drawing back into the vane groove 27 more than a preselected length. Both tips of the vane 30 always make no contact with the inner surface of the center housing with the result that the vane pump is free from thermal and wearing problems due to frictional contact between the vane and center housing.

The diametrical vane 30 has a relatively small radius of gyration as compared with the conventional radial vane because the former has its rotational center near the center of mass. This means that the centrifugal force is also relatively small. The centrifugal force is received through the intermediary of the bearings by the holes. The bearing and the guide hole make a rolling contact with each other, thereby being resistant against abrasion.

Figure 8:
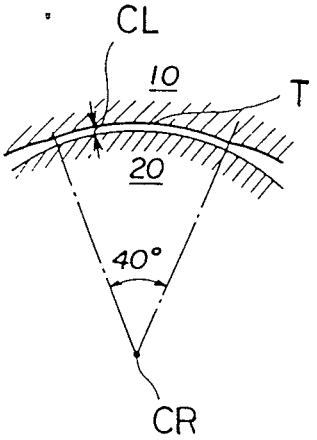
FIG. 8 is a partial enlarged section of the center housing and the rotor of another embodiment.

As seen in FIG. 8, the inner surface of the center housing 10 can have a cross-sectionally arcuate part in the vicinity of the top point T. The arcuate part has a center CR common to the rotor 20 and a radius larger by a preselected clearance CL than the radius of the rotor. For example, the arcuate part has a center angle of 40 degrees about the center CR and a radius larger by 0.05 mm than the radius of the rotor. The arcuate part improves in sealing about the top point T in which the rotor 20 lies in the most proximity to the center housing 10.

Figure 9:
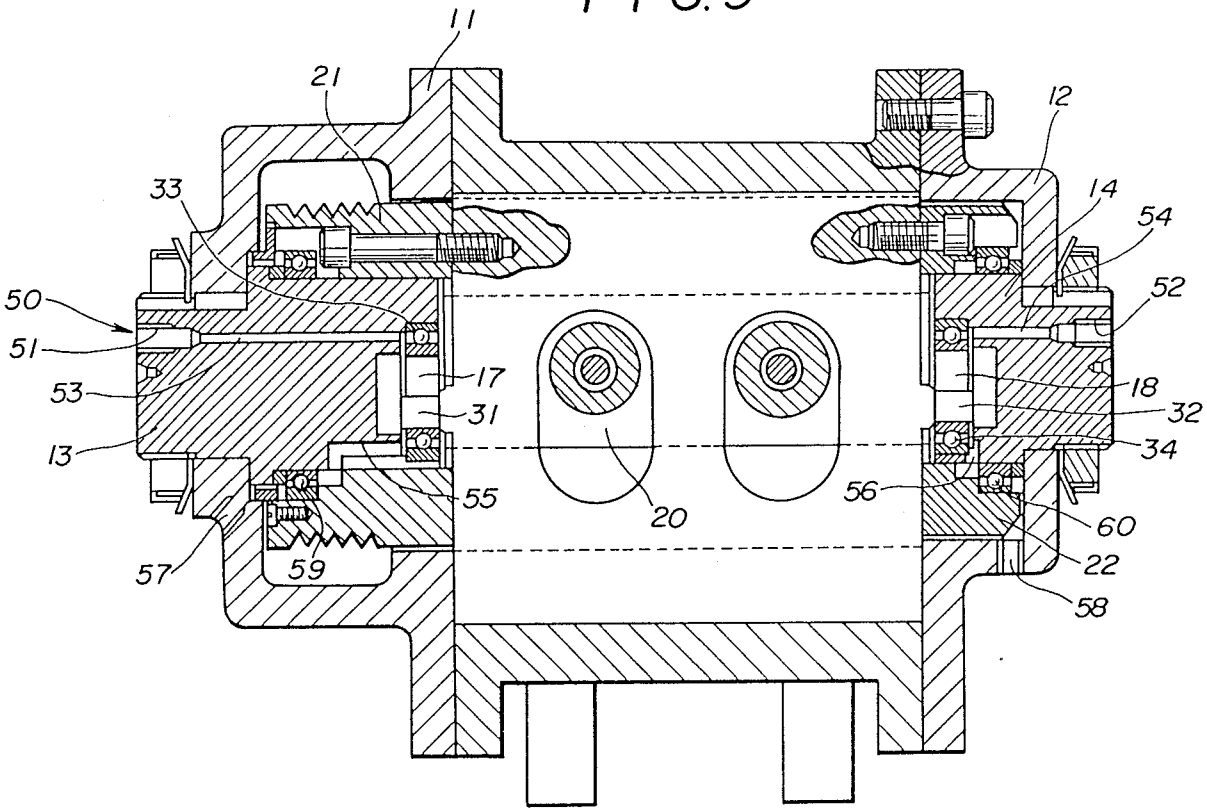
FIG. 9 is a view, similar to FIG. 1, of another embodiment.

As seen in FIG. 9, when the rolling bearings are required to carry heavy loads, larger ball bearings 33 and 34 are closely fitted in the circular holes 17 and 18 and lubricated by a circulating oil system 50. The axles 31 and 32 are loosely received within the inner race of the bearings 33 and 34. The inner diameter of the bearings 33 and 34 are larger by the eccentricity of the rotor 20 than the outer diameter of the axles 31 and 32. The circulating oil system 50 has oil inlets 51 and 52 formed in the front and rear shafts 13 and 14, first passages 53 and 54 from the inlets 51 and 52 to the ball bearings 33 and 34, second passages 55 and 56 from the ball bearings 33 and 34 to the outlets 57 and 58 formed in the front and rear housings 11 and 12. The second passages 55 and 56 are also used for lubrication of the ball bearings 59 and 60 fitted on the front and rear shafts 13 and 14 to rotatably support the front and rear blocks 21 and 22 integral with the rotor 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vane pump comprising a center housing, front and rear housings holding said center housing therebetween, a rotor eccentrically disposed in said center housing and rotatably supported by said front and rear housings, a single vane diametrically movably inserted in said rotor, a plurality of bolts and spacers, and guide means for regulating the projection of said vane out of said rotor, said guide means comprising an axle provided centrally on each side of said vane, a circular hole formed in the inner surface of each of said front and rear housings to receive said axle and having a center just in the middle between the centers of said rotor and said center housing, and a roller bearing interposed between said axle and said circular hole to guide said axle in a circular path with a diameter equal to the eccentric radius of said rotor, said center housing having an inner surface with a cross-sectional profile that is firstly drawn by the tip of said vane when said rotor turns and then expanded by a preselected clearance, said front and rear housings being respectively provided with front and rear shafts axially aligned with said rotor, said rotor having front and rear blocks rotatably fitted on said front and rear shafts, said rotor having a pair of generally semicylindrical bodies joined to each other with the intervention of said front and rear blocks to form a vane groove therebetween, and said vane being centrally formed with a long hole having the plurality of bolts and spacers positioned therein to maintain said vane groove.

2. The vane pump of claim 1, wherein said profile has a top portion in the form of an arc with a radius including said preselected clearance which is larger than the radius of said rotor.

3. The vane pump of claim 1, wherein said roller bearing has an inner race closely fitted on said axle and an outer diameter including an eccentric radius of said rotor which is smaller than said circular hole.

4. The vane pump of claim 1, wherein said roller bearing has an outer race closely fitted in said circular hole and an inner diameter including the eccentric radius of said rotor which is larger than said axle.

5. The vane pump of claim 1, wherein said front block is shaped in the form of a driven pulley.

6. The vane pump of claim 1, wherein said roller bearings are lubricated by a circulating oil system provided with inlets formed in said front and rear shafts, first passages from said inlets to said roller bearings, and second passages from said roller bearings to outlets being provided in said front and rear housings.

* * * * *